US006059268A

United States Patent [19]

Santelli, Jr.

[11] Patent Number: 6,059,268

[45] Date of Patent: May 9, 2000

[54] BUMPER SYSTEM FOR LIMITING THE MOBILITY OF A WHEELED DEVICE

[76] Inventor: Albert Santelli, Jr., 205 Hallock Ave., Middlesex, N.J. 08846

[21] Appl. No.: 09/072,776

[22] Filed: May 6, 1998

[51] Int. Cl.[7] ..... E04H 17/00; E01C 11/22

[52] U.S. Cl. ..... 256/25; 256/1; 52/102

[58] Field of Search ..... 256/1, 25

[56] References Cited

U.S. PATENT DOCUMENTS

| | | | |
|---|---|---|---|
| 4,726,614 | 2/1988 | Myers et al. | 293/128 |
| 4,795,151 | 1/1989 | Mulcaster . | |
| 5,069,311 | 12/1991 | Young . | |
| 5,345,731 | 9/1994 | Sykes . | |
| 5,346,731 | 9/1994 | Sykes | 256/1 |
| 5,626,330 | 5/1997 | Young | 256/1 |

*Primary Examiner*—Joseph D. Pape
*Assistant Examiner*—Kiran Patel
*Attorney, Agent, or Firm*—Paul A. Schwarz; Buchanan Ingersoll

[57] ABSTRACT

A bumper for limiting the limiting the mobility of a wheeled device. The bumper is an elongated member having a base wall and an elastically resilient wheel engagement wall coupled to the base wall. The wheel engagement wall includes an outer surface and an inner surface, one of which includes reliefs for aiding the wall to conform to and stop the rolling action of a wheel of a wheeled device when impacted thereby. The energy stored in the engagement wall when impacted by the wheel of the wheeled device returns the engagement wall to its original shape thereby pushing the wheel of the wheeled device away from the elongated member. A bumper system may be fabricated by connecting two or more of the bumpers together in a desired configuration using adjustable, straight, or bent connectors.

8 Claims, 6 Drawing Sheets

BUMPER SYSTEM FOR LIMITING THE MOBILITY OF A WHEELED DEVICE

FIELD OF THE INVENTION

This invention relates to a floor or ground mounted apparatus for stopping a wheeled device. In particular, this invention relates to a floor or ground mounted bumper system comprised of one or more elastically resilient bumpers which can be connected together to make a desired boundary that limits the movement of a wheeled device such as a baby walker.

BACKGROUND OF THE INVENTION

There are many wheeled devices such as baby walkers which are self-propelled by an infant or a young child. Such devices are used indoors in the home for exercising and entertaining the infant or child.

A typical baby walker is comprised of a seat or harness which is suspended or supported in frame-like structure. The frame-like structure is mounted on at least four wheels or casters. The infant or child is placed in the seat or harness with his or her legs extending to the ground in a standing or almost standing position. The infant or child may move about in any desired direction in the walker by pushing against the ground with his or her legs.

Unfortunately, these baby walkers provide the infant or child with mobility that enables him or her to gain access to areas in the home which are extremely dangerous, such as stairs, balconies, raised decks and porches, and the like. Moreover, because the infant or child can move about the home in a standing or almost standing position, the infant or child can reach objects such as television sets, video cassette recorders, plants, and other similar objects which can cause the infant or child injury or be damaged by the infant or child.

The prior art has addressed these problems by providing various floor mounted stop member designs. These prior art floor stop members may be used alone as a single unit or in multiple units to provide a predetermined boundary for limiting the movement of a baby walker. When one or more wheels of a baby walker engages a typical stop member, the rolling action of the wheel is stopped thereby preventing the baby walker from moving past or over the stop member.

However, prior art stop members are not designed to be connected to each other when used in multiple units. Unless each of the stop members are permanently fastened to the floor, an infant or child in a baby walker may succeed in dislodging one of the stop members, thus, gaining access to a dangerous object or area.

Accordingly, there is a need for an improved apparatus for limiting the mobility of a wheeled device such as a baby walker, which is substantially less likely of being defeated if one of the stop members is dislodged.

SUMMARY OF THE INVENTION

The present invention relates to a bumper for limiting the mobility of a wheeled device. The bumper comprises an elongated member having a base wall and an elastically resilient wheel engagement wall coupled to the base wall. The wheel engagement wall includes an outer surface and an inner surface, one of which includes relief means for aiding the wall to conform to a wheel of a wheeled device when impacted thereby. The energy stored in the engagement wall, when impacted by the wheel of the wheeled device, returns the engagement wall to its original shape thereby pushing the wheel of the wheeled device away from the bumper.

The present invention also relates to a bumper system comprised of at least two bumpers and coupling means for connecting the bumpers to one another.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It should be understood that the drawings are for purposes of illustrating the concepts of the invention and are not to scale.

DETAILED DESCRIPTION OF THE INVENTION

Figure 1:
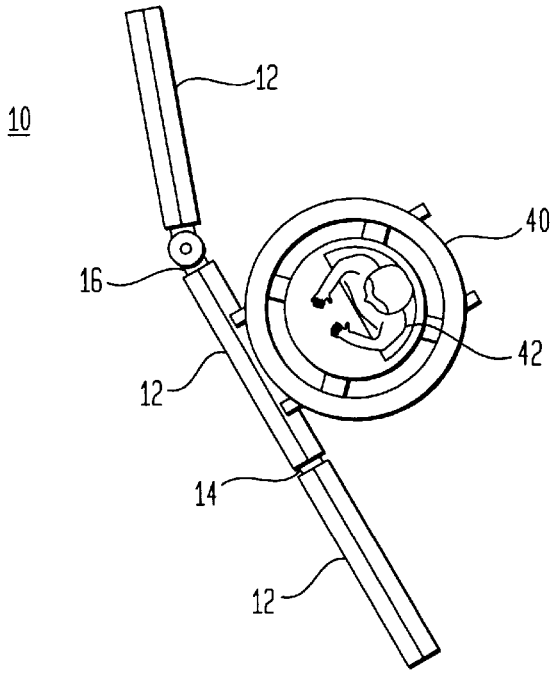
FIG. 1 shows a top plan view of a bumper system for limiting the mobility of a child in a baby walker according to an embodiment of the invention.

FIG. 1 shows a top plan view of a bumper system 10 for limiting the mobility of a child 42 in a baby walker 40, thus, aiding in the supervision of the child 42. The bumper system 10 may also be used for limiting the mobility of other wheeled devices. The bumper system 10 comprises one or more elastically resilient bumpers 12 which may be connected or linked to each other with straight connectors 14 and/or adjustable connectors 16. The connectors 14, 16 may be inserted into the ends of the bumpers 12 to allow the bumpers 12 to be arranged in an almost unlimited variety of boundary patterns. Because the bumpers are connected to each other, the boundary defined by the system will be substantially maintained even if one of the bumpers should become momentarily dislodged from the floor.

Figure 2A:
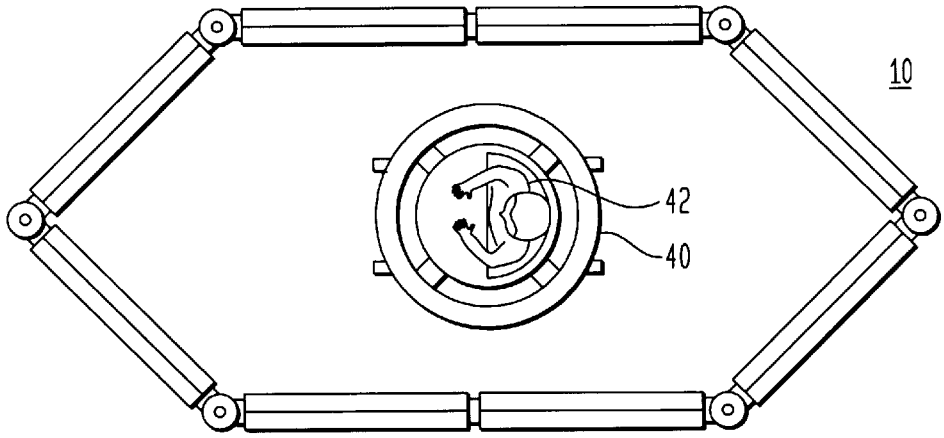
FIGS. 2A and 2B are top plan views showing the bumper system arranged in a closed loop-like structure.
Figure 2B:
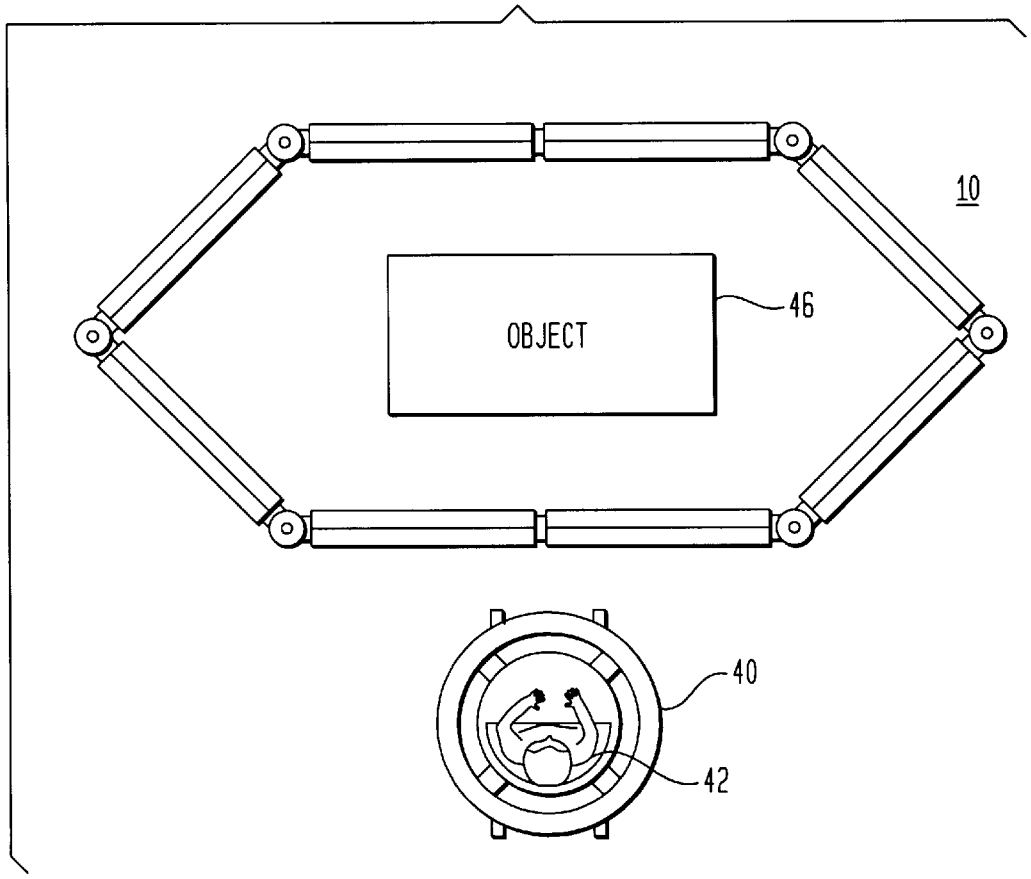

The number of bumpers 12 and connectors 14, 16 used in the bumper system 10 generally depends upon the size and shape of the desired area to bounded. FIGS. 2A and 2B show the bumper system 10 arranged in a closed loop-like structure. In FIG. 2A, the bumper system 10 is used for maintaining the child 42 in the baby walker 40 within a bounded area. In FIG. 2B, the bumper system 10 is used for surrounding an object 46 such as a television set or a Christmas Tree, to prevent the child 42 in the baby walker 40 from gaining access to the object 46.

The bumper system 10 may also be arranged in an open loop-like structure as shown in FIG. 1. Such a structure is useful in preventing the child 42 in the baby walker 40 from passing through a doorway or archway.

Figure 3:
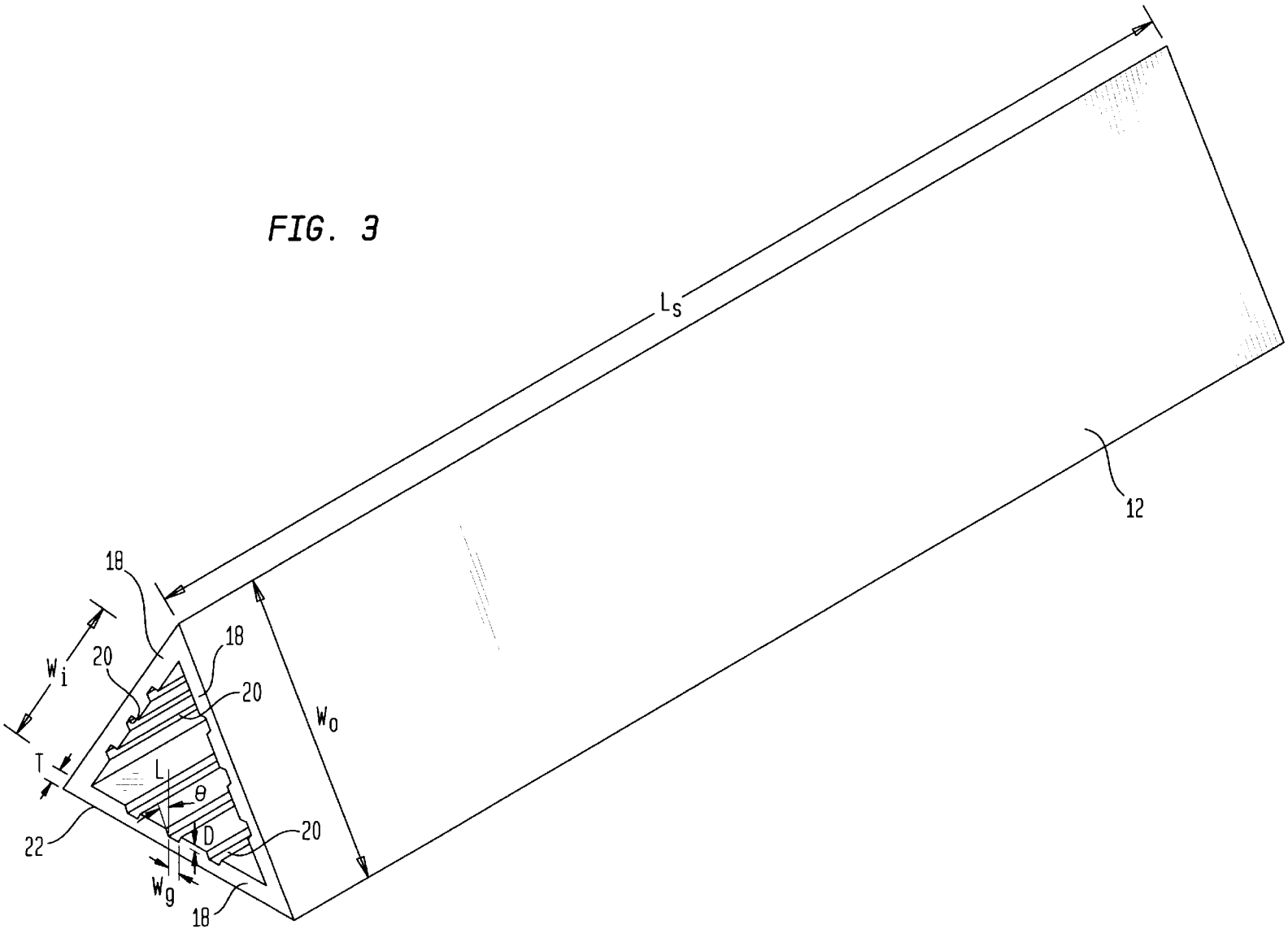
FIG. 3 is a detailed perspective view of one of the bumpers according to an embodiment of the invention.

FIG. 3 is a detailed perspective view of one of the bumpers 12. The bumper 12 comprises a hollow, triangular-shaped elongated member defined by three elastically resilient walls 18. The bumper 12 is hollow to allow the connectors 14, 16 to be inserted therein. The inner surface of each wall may include a plurality of grooves or reliefs 20 which aid in conforming the walls 18 to the shape of a baby walker wheel when impacted thereby. The bumpers 12 are preferably extruded from a thermal plastic rubber having a durometer value of about 75, although thermal plastic rubber with durometer values ranging between about 35 and 115 may also be used. Thermal plastic rubber is preferred because it is somewhat tacky and, therefore, tends to grip most surfaces. Bumpers fabricated using methods other than extrusion and from other elastically resilient materials are also contemplated.

If additional skid or slide prevention is required, a portion or the entire outer surface of one of the walls may be provided with adhesive means 22. The adhesive means 22 may comprise a double sided adhesive tape or a coating of adhesive applied to the wall. Alternatively, raised gripping ribs (not shown) may be provided on the outer surface of one or more of the walls 18 in order to prevent the bumpers from sliding on the floor surface when engaged by the baby walker wheels.

The visibility and marketability of the bumper system 10 can be enhanced by fabricating the bumpers 12 from a brightly colored version of the thermal plastic rubber. Providing a brightly colored bumper 12 enhances the safety of the bumper system 10 because it makes the bumpers 12 more noticeable when mounted on a floor or surface.

The bumpers 12 may be dimensioned as desired, depending upon the size and weight of the wheeled device to be bounded. Bumpers used for bounding baby walkers may include 0.100 inch thick walls as measured at T, outer wall surfaces which are each approximately 1.250 inches wide as measured at $W_o$, an inner wall surfaces which are approximately 0.904 inches wide as measure at $W_i$. The grooves 20 defined in the inner surfaces of the walls 18 may be approximately 0.025 inches in depth as measured at D and approximately 0.050 wide as measured at the bottom surface of the groove at $W_g$. The side surfaces of the groove may taper outwardly from the bottom surface of the groove at about 25 degree angle θ as measured from an imaginary line L extending perpendicular to the bottom surface of the groove. The length $L_s$ of a baby walker bumper may be approximately 24 inches.

Figure 4:
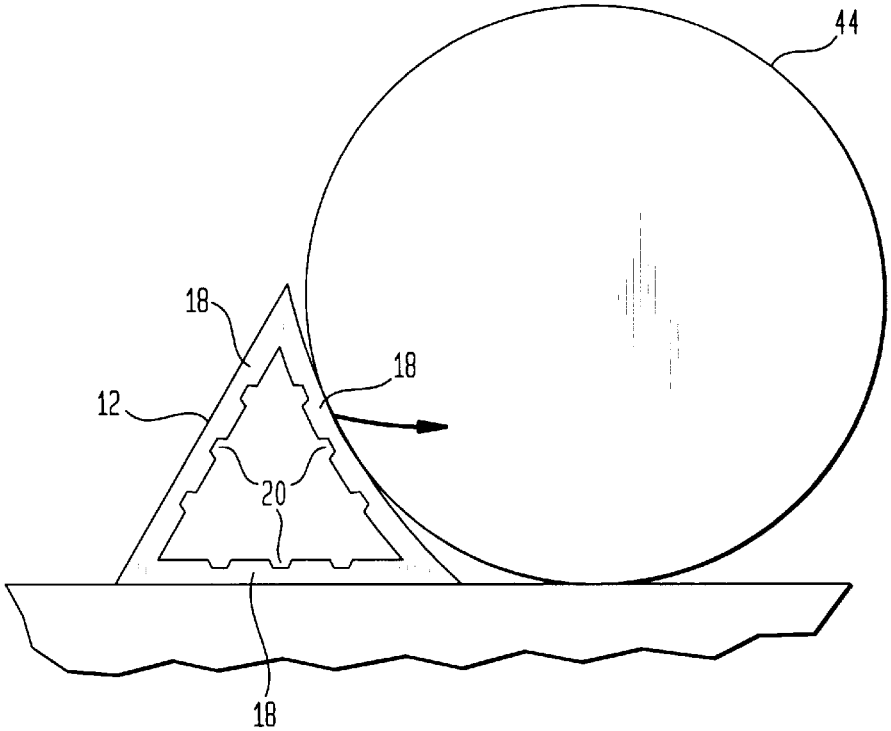
FIG. 4 is a side elevational view showing a bumper impacted by one of the wheels of a baby walker.

FIG. 4 shows a bumper 12 impacted by one of the wheels 44 of the baby walker 40. As the wheel 44 rolls into the bumper 12, the wall 18 engaged by the wheel 44 distorts to conform with the shape of the wheel 44 to stop the rolling action thereof. Once the rolling action has been halted, the energy stored in the distorted wall 18 returns it to its original shape thereby pushing the wheel 44 of the baby walker away from the bumper 12.

Figure 5A:
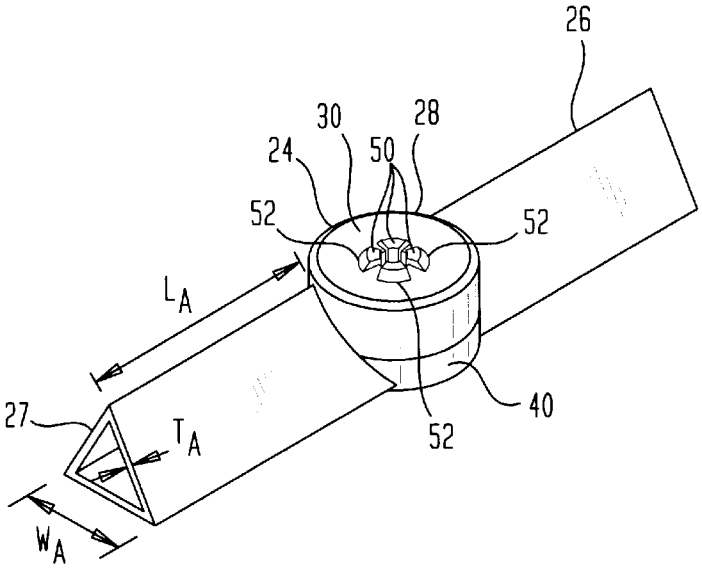
FIG. 5A is a perspective view showing an adjustable connector which may be used for linking or connecting two bumpers together.
Figure 5B:
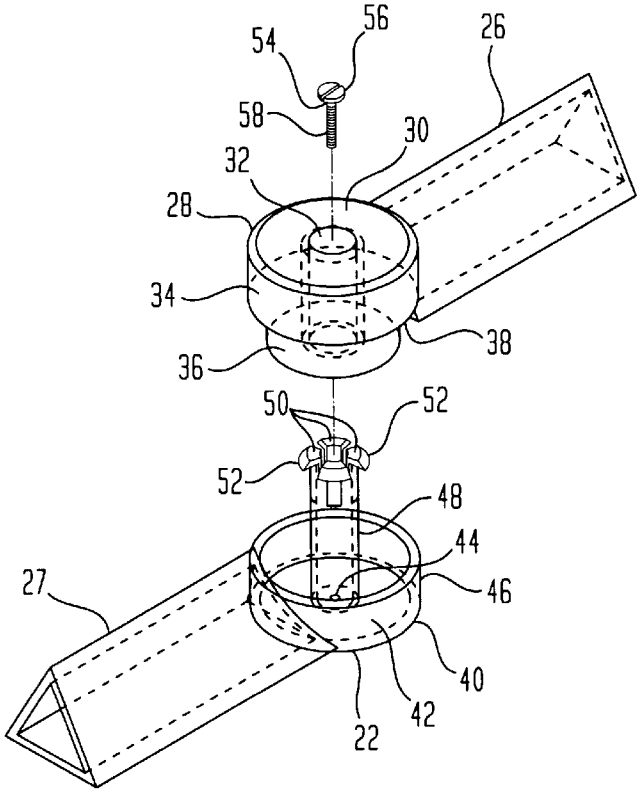
FIG. 5B is an exploded perspective view of the adjustable connector of FIG. 5A.
Figure 5C:
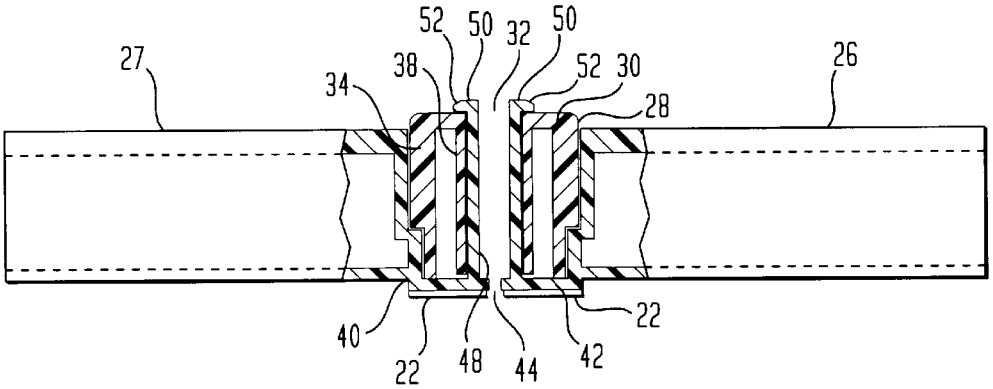
FIG. 5C is a partial cross-sectional side view of the adjustable connector of FIG. 5A.

FIGS. 5A–5C show the adjustable connector 16 used for linking or connecting two bumpers 12 together in an angled manner. The adjustable connector 16 comprises a cylindrical hub assembly 24 with first and second arms 26, 27 extending radially therefrom. The hub assembly 24 includes a top member 28 and a base member 40. The top member 28 includes a circular top wall 30 with a central aperture 32 and a cylindrical side wall 34 depending down from the top wall 30. The outer surface of the cylindrical side wall 34 is relieved at the marginal free end thereof to form an inwardly stepped cylindrical surface 36. A cylindrical bushing 38 (best shown in FIG. 5C) extends down from the perimeter of the aperture 32 in the top wall 30. The first arm 26 extends radially away from the outer surface of the side wall 34.

The base member 40 includes a circular bottom wall 42 with a central aperture 44 and a cylindrical side wall 46 depending up from the bottom wall 42. The second arm 27 extends radially away from the outer surface of the side wall 46. A tubular axle 48 extends up from the bottom wall 42 and is coaxial with the aperture 44. The terminal end of the tubular axle 48 defines a castellated arrangement of elastically resilient radially projecting barbs 50 each having a beveled outermost edge surface 52. The tubular axle 48 is slightly longer than the bushing 38 of the top member 28 so that the barbs 50 extend over the top wall 30 (FIGS. 5A and 5C) when the hub members 28, 40 are assembled together. The inner diameter of the side wall 46 is sized for receiving the inwardly stepped cylindrical surface section 36 of the top member's side wall 34.

The top and base members 28, 40 are assembled by inserting the tubular axle 48 of the base member 40 into the bushing 38 of the top member 28 and then seating the inwardly stepped surface portion 36 of the top member's side wall 34 within the base member 40. The resilient nature of the barbs 50 allow them to bend radially inwardly toward each other as they enter and slide through the bushing 38 and then snap over the top wall of the top member 28 to retain the members 28, 40 together. The beveled edge surfaces 52 of the barbs 50 facilitate entry into the bushing 38. Once assembled, the hub members 28, 40 can be rotated relative to each other so that the arms 26, 27 of the connector 16 can be adjustably angled between about 45 and 180 degrees.

The arms 26, 27 of the connector 16 are triangular in shape so that they are insertable into the ends of the bumpers 12 shown in FIG. 3. Friction between the arms 26, 27 of the connector 16 and the bumper 12 prevents inadvertent withdrawal of the arms 26, 27 from the bumpers 12. Each outer wall surface of the arms 26, 27 may be approximately 0.900 inches wide as measured at $W_A$ (FIG. 5A). The wall thickness $T_A$ is about 0.50 inches. Each of the arms 26, 27 is about 3 inches in length as measured at $L_A$. The adjustable connector 16 is preferably injection molded from ABS Plastic material although the connector 16 can be made from other rigid materials using other fabrication methods if desired.

Adhesive means 22 (best shown in FIG. 5C) can also be applied to the outer surface of the bottom wall 42 of the base member 40 to prevent sliding. Moreover, a screw 54 (FIG. 5B) may be provided for permanently mounting the adjustable connector 16 to the floor surface if desired. The screw 54 includes a head 56 and a threaded shank 58. The head 56 of the screw 54 is sized to be inserted through the tubular axle 48 and the threaded shank 58 is sized to be inserted through the aperture 44 in the base member's bottom wall 42.

Figure 6:
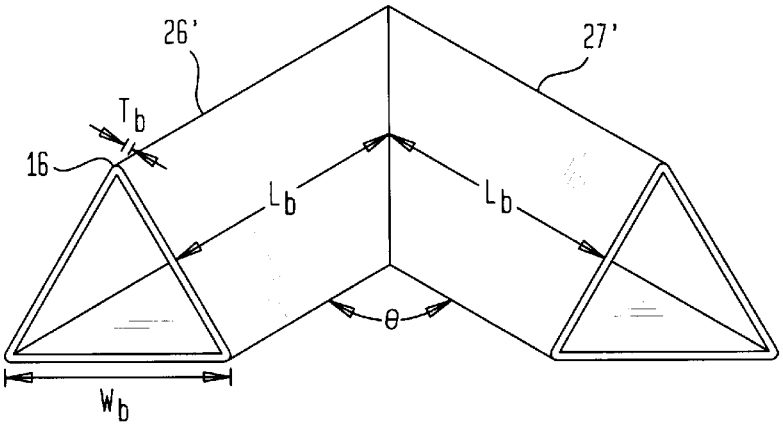
FIG. 6 is a perspective view showing a bent connector which may be used for linking or connecting two bumpers together in an angled manner.

FIG. 6 shows a bent connector 16' which may be used in place of or with the adjustable connector 16 for linking or connecting two bumpers 12 together in an angled manner. The bent connector 16' preferably comprises a hollow or solid rigid member having first and second arms 26', 27' which are shaped and dimensioned to be inserted into the bumpers 12. The arms 26', 27' of the bent connector 16' are triangular in shape to correspond to the bumpers 12 shown in FIG. 3. The angle θ defined between the arms 26', 27' can range approximately between 90 and 120 degrees although, bent connectors constructed with arms defining other angles are possible. Friction between the arms 26', 27' of the connector 16' and the bumpers 12 prevents inadvertent withdrawal therefrom. Each outer wall surface of the arms may be approximately 0.900 inches wide as measured at $W_b$. The wall thickness $T_b$ is about 0.50 inches. The arms 26', 27' may be each about 3 inches in length as measured at $L_b$. The connector 16' is preferably made from a rigid PVC material although the connector 16' can be made from other rigid materials if desired.

Figure 7:
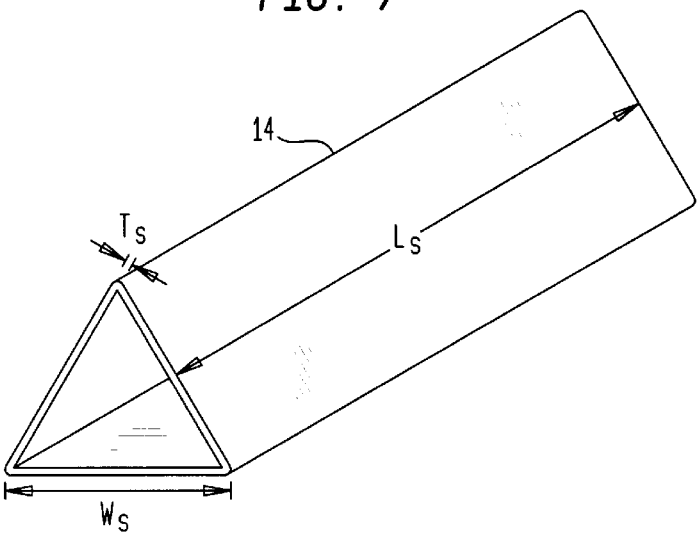
FIG. 7 is a perspective view showing a straight connector which may be used for linking or connecting two bumpers together in a linear manner.

FIG. 7 shows the straight connector 14 used for linking or connecting two bumpers 12 together in a linear manner. The straight connector 14 comprises a triangular-shaped hollow or solid rigid member dimensioned to be inserted into the bumpers 12 of FIG. 3. Friction between the connector 14 and the bumpers 12 prevents inadvertent withdrawal therefrom. Each outer wall surface of the straight connector may be approximately 0.900 inches wide as measured at $W_s$. The wall thickness $T_s$ is 0.50 inches. The straight connector 14 may be about 6 inches in length as measured at $L_s$. The straight connector 14 is preferably made from a rigid PVC material although the straight connector 14 can be made from other rigid materials if desired.

Figure 8:
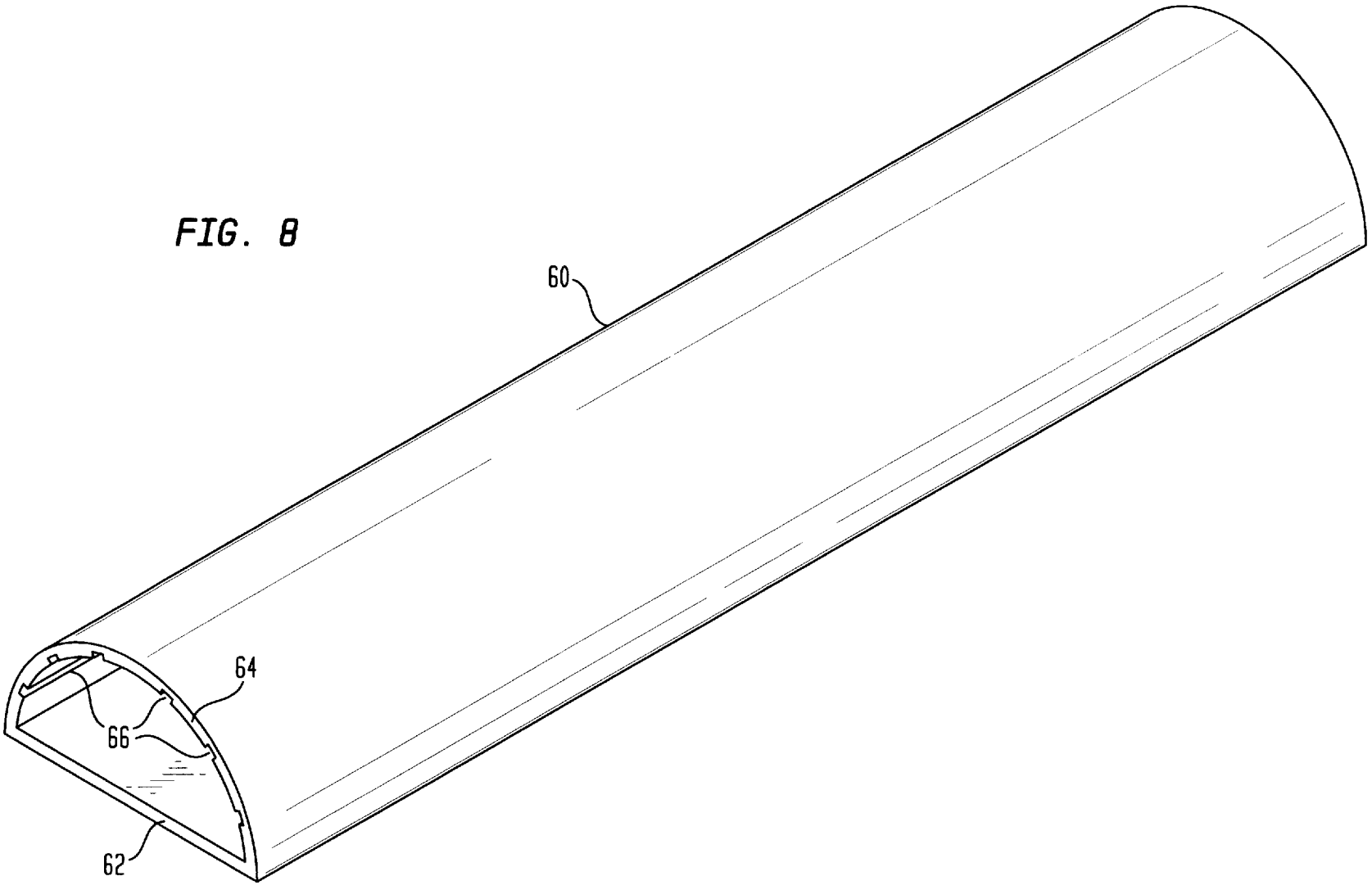
FIG. 8 is a perspective view showing a bumper according to a second embodiment of the invention.

FIG. 8 shows a bumper 60 according to a second embodiment of the present invention. The bumper 60 comprises a hollow, D-shaped elongated member defined by a substantially flat elastically resilient base wall 62 and an arcuate, elastically resilient upper wall 64. The inner surface of the upper wall 64 may also include a plurality of grooves or reliefs 66 which aid in allowing the wall 64 to deform and therefore, conform to the shape of a baby walker wheel. Correspondingly shaped connectors having a D-shape (not shown) may also be provided for coupling the D-shaped bumpers together.

It should be understood that the above described embodiments are illustrative of only a few of the many possible specific embodiments which can represent applications of the principles of the invention. Numerous and varied other arrangements can be devised by those skilled in the art without departing from the spirit and scope of the invention.

What is claimed is:

1. A bumper for limiting the mobility of a wheeled device, the bumper comprising an elongated member having a base wall and an elastically resilient wheel engagement wall coupled to the base wall, the wheel engagement wall including an outer surface and an inner surface, one of the outer and the inner surfaces including relief means for aiding the elastically resilient engagement wall to conform to and stop the rolling action of a wheel of the wheeled device when impacted thereby, the energy stored in the engagement wall returning the engagement wall to its original shape to push the wheel of the wheeled device away from the bumper.

2. The bumper according to claim 1, wherein the elongated member includes a second wheel engagement wall coupled to the base member.

3. The bumper according to claim 1, wherein the elongated member is triangular in shape.

4. The bumper according to claim 1, wherein the elongated member is hollow.

5. The bumper according to claim 2, wherein the second engagement wall includes said relief means.

6. The bumper according to claim 1, wherein the base wall includes said relief means.

7. The bumper according to claim 1, wherein the elongated member is made from a thermal plastic rubber material.

8. The bumper according to claim 7, wherein the thermal plastic rubber material has a durometer which ranges between about 35 and about 115.

* * * * *

UNITED STATES PATENT AND TRADEMARK OFFICE

CERTIFICATE OF CORRECTION

PATENT NO. : 6,059,268

DATED : May 9, 2000

INVENTOR(S) : Albert Santelli, Jr.

It is certified that error appears in the above-identified patent and that said Letters Patent are hereby corrected as shown below:

In section [57], line 1 of the Abstract presently reads, "A bumper for limiting the limiting the mobility of a wheeled device."

Please correct line to read, --A bumper for limiting the mobility of a wheeled device.--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*